US010007283B2

(12) United States Patent
Takada et al.

(10) Patent No.: US 10,007,283 B2
(45) Date of Patent: Jun. 26, 2018

(54) VOLTAGE REGULATOR

(71) Applicant: SII Semiconductor Corporation, Chiba-shi, Chiba (JP)

(72) Inventors: Kosuke Takada, Chiba (JP); Masayuki Uno, Chiba (JP)

(73) Assignee: ABLIC INC., Chiba (JP)

( * ) Notice: Subject to any disclaimer, the term of this patent is extended or adjusted under 35 U.S.C. 154(b) by 0 days. days.

(21) Appl. No.: 15/458,447

(22) Filed: Mar. 14, 2017

(65) Prior Publication Data

US 2017/0269622 A1 Sep. 21, 2017

(30) Foreign Application Priority Data

Mar. 15, 2016 (JP) ..... 2016-051497

(51) Int. Cl.
*G05F 1/573* (2006.01)
*G05F 1/575* (2006.01)
*G05F 3/08* (2006.01)

(52) U.S. Cl.
CPC ..... *G05F 1/573* (2013.01); *G05F 1/575* (2013.01); *G05F 3/08* (2013.01)

(58) Field of Classification Search
CPC . G05F 1/56; G05F 1/565; G05F 1/569; G05F 1/573; G05F 1/575
See application file for complete search history.

(56) References Cited

U.S. PATENT DOCUMENTS

2003/0011952 A1 1/2003 Fukui
2003/0128489 A1* 7/2003 Katoh ..... G05F 1/575 361/93.9
2007/0273346 A1* 11/2007 Lin ..... G05F 1/573 323/276
2008/0278127 A1* 11/2008 Nagata ..... G05F 1/56 323/276
2009/0273323 A1* 11/2009 Kimura ..... G05F 1/56 323/265
2010/0156373 A1* 6/2010 Imura ..... G05F 1/56 323/282
2012/0194147 A1* 8/2012 Socheat ..... G05F 1/575 323/265
2012/0262137 A1* 10/2012 Arigliano ..... G05F 1/573 323/277
2013/0063115 A1* 3/2013 Hikichi ..... G05F 1/575 323/284

(Continued)

*Primary Examiner* — Fred E Finch, III
(74) *Attorney, Agent, or Firm* — Brinks Gilson & Lione

(57) ABSTRACT

Provided is a voltage regulator capable of suppressing fluctuation in a limited current. The voltage regulator includes: a first differential amplifier circuit configured to compare a voltage based on an output voltage and a reference voltage to each other, to thereby output a first voltage; a second differential amplifier circuit configured to compare the first voltage and a second voltage to each other, to thereby output a third voltage; a first transistor configured to receive the third voltage at a gate thereof such that the output voltage is generated at a drain thereof; a second transistor, which includes a gate connected in common to the gate of the first transistor and has a predetermined size ratio to the first transistor; and a voltage generating unit, which includes one end connected to a drain of the second transistor and is configured to generate the second voltage at the one end.

3 Claims, 5 Drawing Sheets

(56) References Cited

U.S. PATENT DOCUMENTS

| | | | | |
|---|---|---|---|---|
| 2014/0184182 | A1* | 7/2014 | Yajima | G05F 1/575 323/273 |
| 2014/0266098 | A1* | 9/2014 | Dao | G05F 1/573 323/273 |

* cited by examiner

VOLTAGE REGULATOR

RELATED APPLICATIONS

This application claims priority under 35 U.S.C. § 119 to Japanese Patent Application No. 2016-051497 filed on Mar. 15, 2016, the entire content of which is hereby incorporated by reference.

BACKGROUND OF THE INVENTION

1. Field of the Invention

The present invention relates to a voltage regulator, and more particularly, to a voltage regulator having an overcurrent protection function.

2. Description of the Related Art

FIG. 4 is a circuit diagram for illustrating a related-art voltage regulator 300.

The related-art voltage regulator 300 includes a power supply terminal 301, a ground terminal 302, a reference voltage source 310, an error amplifier circuit 311, resistors 312, 317, 318, and 319, an NMOS transistor 316, PMOS transistors 313, 314, and 315, and an output terminal 320.

The PMOS transistor 315 has a source connected to the power supply terminal 301, and a drain connected to the output terminal 320 and one end of the resistor 318. The resistor 318 has another end connected to one end of the resistor 319 and a non-inverting input terminal of the error amplifier circuit 311. The resistor 319 has another end connected to the ground terminal 302. The PMOS transistor 314 has a source connected to the power supply terminal 301, and a drain connected to one end of the resistor 317 and a gate of the NMOS transistor 316. The PMOS transistor 313 has a source connected to the power supply terminal 301, a drain connected to a gate of the PMOS transistor 315, a gate of the PMOS transistor 314, and an output of the error amplifier circuit 311. The resistor 312 has one end connected to the power supply terminal 301, and another end connected to a gate of the PMOS transistor 313 and a drain of the NMOS transistor 316. The error amplifier circuit 311 has an inverting input terminal connected to one end of the reference voltage source 310. The reference voltage source 310 has another end connected to the ground terminal 302. The NMOS transistor 316 has a source connected to the ground terminal 302.

The related-art voltage regulator 300 operates such that, through a negative feedback circuit forming of the error amplifier circuit 311, the PMOS transistor 315, and the resistors 318 and 319, a voltage at the one end of the resistor 319 is equal to a voltage VREF at the reference voltage source 310.

When a current that flows to a load (not shown) connected to the output terminal 320 increases in this state, a drain current I1 of the PMOS transistor 315 increases. Then, a drain current I2 of the PMOS transistor 314, which is formed to have a predetermined size ratio to the PMOS transistor 315, also increases. The current I2 is supplied to the resistor 317 such that a voltage Vx is generated at the one end of the resistor 317. When the voltage Vx increases to exceed a threshold of the NMOS transistor 316, the NMOS transistor 316 is turned on, to thereby generate a drain current. The drain current of the NMOS transistor 316 is supplied to the resistor 312, such that a voltage at the other end thereof decreases, to thereby turn on the PMOS transistor 313. When the PMOS transistor 313 is turned on, a gate voltage of the PMOS transistor 315 increases, thereby limiting the drain current I1.

Now, when a resistance value of the resistor 317 is represented by R1, the size ratio between the PMOS transistors 315 and 314 is represented by K, and a threshold voltage of the NMOS transistor 316 is represented by |VTHN|, a limited current I1*m* of the current I1 is expressed by Expression (1).

$$I1m = \frac{K \times VTHN}{R1} \tag{1}$$

As described above, the related-art voltage regulator 300 has an overcurrent protection function, and an output current may be limited when the load is short-circuited, for example (see, for example, Japanese Patent Application Laid-open No. 2003-29856).

However, the related-art voltage regulator 300 has a problem in that fluctuation in the limited current I1*m* is large. This is because fluctuation in the threshold voltage VTHN affects the limited current I1*m*, as can be seen in Expression (1).

FIG. 5 is a graph for showing a waveform of an output voltage VOUT relative to an output current IOUT of the related-art voltage regulator 300. The dotted lines indicate a fluctuation range of the limited current. In general, the fluctuation in the threshold voltage VTHN is about ±0.1 from a center value of 0.6 V, and hence the fluctuation in the limited current I1*m* caused by the threshold voltage VTHN is ±16.7%, which is a very large fluctuation.

SUMMARY OF THE INVENTION

The present invention has been made in order to solve the above-mentioned problem, and provides a voltage regulator capable of suppressing fluctuation in a limited current.

According to one embodiment of the present invention, there is provided a voltage regulator including: a first differential amplifier circuit configured to compare a voltage based on an output voltage and a reference voltage to each other, to thereby output a first voltage; a second differential amplifier circuit configured to compare the first voltage and a second voltage to each other, to thereby output a third voltage; a first transistor configured to receive the third voltage at a gate of the first transistor such that the output voltage is generated at a drain of the first transistor; a second transistor, which includes a gate connected in common to the gate of the first transistor and has a predetermined size ratio to the first transistor; and a voltage generating unit, which includes one end connected to a drain of the second transistor and is configured to generate the second voltage at the one end.

According to the voltage regulator of the present invention, the first voltage, which is an output voltage of the first differential amplifier circuit, is a reference value for a limited current of a drain current of the first transistor, and the second voltage, which is generated by the second transistor and the voltage generating unit, is a value in proportion to the drain current of the first transistor. Those first and second voltages are compared to each other by the second differential amplifier circuit, which forms a negative feedback circuit with the second transistor and the voltage generating unit, to thereby achieve an overcurrent protection. At this time, fluctuation in the limited current, which is a criterion for determining an overcurrent, is almost completely dependent on fluctuation in the reference voltage. Therefore, for example, by generating the reference voltage using a voltage source in which fluctuation is significantly small, for example, a bandgap voltage source, the fluctuation in the limited current can be suppressed.

DETAILED DESCRIPTION OF THE PREFERRED EMBODIMENTS

Now, embodiments of the present invention are described with reference to the drawings.

Figure 1:
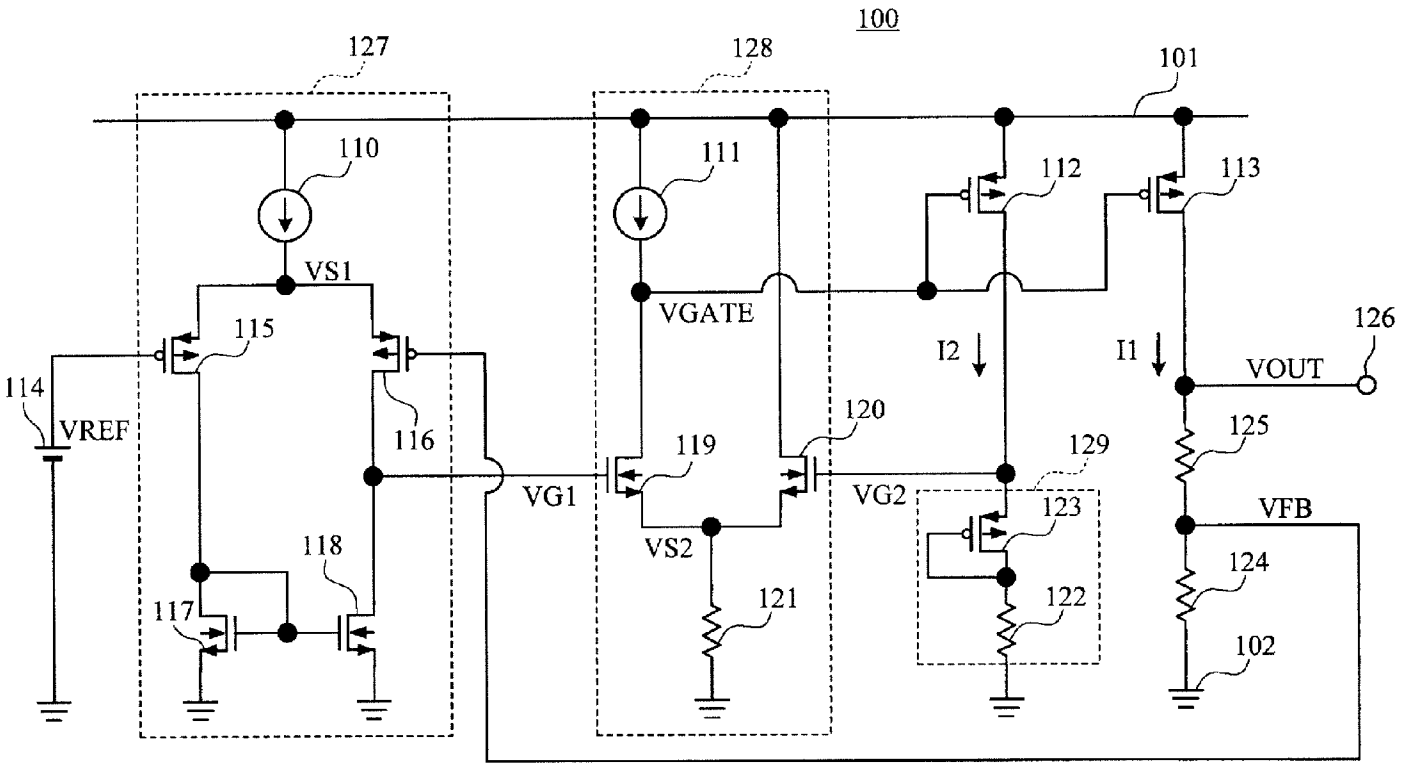
FIG. 1 is a circuit diagram for illustrating a voltage regulator of a first embodiment of the present invention.

FIG. 1 is a circuit diagram for illustrating a voltage regulator 100 of a first embodiment of the present invention.

The voltage regulator 100 of this embodiment includes a power supply terminal 101, a ground terminal 102, a first differential amplifier circuit 127, a second differential amplifier circuit 128, a voltage generating unit 129, PMOS transistors 112 and 113, a reference voltage source 114, resistors 124 and 125, and an output terminal 126.

The first differential amplifier circuit 127 includes PMOS transistors 115 and 116, NMOS transistors 117 and 118, and a current source 110.

The second differential amplifier circuit 128 includes NMOS transistors 119 and 120, a current source 111, and a resistor 121.

The voltage generating unit 129 includes a PMOS transistor 123 and a resistor 122.

The PMOS transistor 113 has a source connected to the power supply terminal 101, and a drain connected to the output terminal 126 and one end of the resistor 125. The PMOS transistor 112 has a source connected to the power supply terminal 101, and a drain connected to one end of the voltage generating unit 129 (source of PMOS transistor 123) and a gate of the NMOS transistor 120. The current source 111 has one end connected to the power supply terminal 101, and another end connected to a drain of the NMOS transistor 119, a gate of the PMOS transistor 112, and a gate of the PMOS transistor 113. The resistor 125 has another end connected to one end of the resistor 124 and a gate of the PMOS transistor 116. The resistor 124 has another end connected to the ground terminal 102. The PMOS transistor 123 has a gate connected to a drain thereof and one end of the resistor 122. Another end of the resistor 122 (another end of voltage generating unit 129) is connected to the ground terminal 102. The NMOS transistor 120 has a drain connected to the power supply terminal 101, and a source connected to a source of the NMOS transistor 119 and one end of the resistor 121. The resistor 121 has another end connected to the ground terminal 102. The current source 110 has one end connected to the power supply terminal 101, and another end connected to a source of the PMOS transistor 115 and a source of the PMOS transistor 116. The PMOS transistor 115 has a gate connected to one end of the reference voltage source 114, and a drain connected to a gate and a drain of the NMOS transistor 117. The reference voltage source 114 has another end connected to the ground terminal 102. The PMOS transistor 116 has a drain connected to a gate of the NMOS transistor 119 and a drain of the NMOS transistor 118. The NMOS transistor 118 has a gate connected to the gate of the NMOS transistor 117, and a source connected to the ground terminal 102. The NMOS transistor 117 has a source connected to the ground terminal 102.

In the first differential amplifier circuit 127, the gate of the PMOS transistor 115 and the gate of the PMOS transistor 116 are inputs, and the drain of the PMOS transistor 116 is an output. In the second differential amplifier circuit 128, the gate of the NMOS transistor 119 and the gate of the NMOS transistor 120 are inputs, and the drain of the NMOS transistor 119 is an output.

For illustrative purposes, a drain current of the PMOS transistor 113 is represented by I1, and a drain current of the PMOS transistor 112 is represented by I2. The PMOS transistor 112 has a predetermined size ratio to the PMOS transistor 113, and is configured to operate as a replica element. Further, a voltage at the output terminal 126, a gate voltage of the NMOS transistor 120, a gate voltage of the NMOS transistor 119, a voltage at the another end of the current source 110, a voltage at the one end of the resistor 121, and a voltage at the one end of the reference voltage source 114 are represented by VOUT, VG2, VG1, VS1, VS2, and VREF, respectively. Further, a resistance value of the resistor 122 is represented by R, a voltage at the one end of the resistor 124 is represented by VFB, and a voltage at the another end of the current source 111 is represented by VGATE.

Next, operation of the voltage regulator 100 having the above-mentioned configuration is described.

A first state in which a load current supplied to the output terminal 126 is much smaller than the limited current is described.

In this case, the current I1 and the current I2, which is determined by the size ratio between the PMOS transistor 113 and the PMOS transistor 112, each have a small current value. Further, the current I2 is supplied to the voltage generating unit 129, and hence the voltage VG2, which is generated at the one end of the voltage generating unit 129, also has a small value. When the voltage VG2 is below a threshold of the NMOS transistor 120, the NMOS transistor 120 is off.

In this situation, the first differential amplifier circuit 127 compares the voltage VREF and the voltage VFB to each other, and then amplifies a difference therebetween to output the voltage VG1. In the second differential amplifier circuit 128, the NMOS transistor 120 is off. Thus, the voltage VG1 is amplified by the NMOS transistor 119, the resistor 121, and the current source 111 such that the voltage VGATE is output. The PMOS transistor 113 receives the voltage VGATE at the gate thereof to generate the drain current I1, and then supplies the drain current I1 to a load (not shown) connected to the output terminal 126.

The voltage VOUT is divided by the resistor 125 and the resistor 124 so that the divided voltage is input to the first differential amplifier circuit 127. Through the loop as described above, a negative feedback functions and the first differential amplifier circuit 127 operates such that the voltage VREF and the voltage VFB become equal to each other.

A second state in which the load current increases as compared to the first state is described.

When a current that flows to the load (not shown) connected to the output terminal 126 increases, the current I1 of the PMOS transistor 113 and the current I2 of the PMOS transistor 112 each increase. As a result, the voltage VG2 also increases, to thereby turn on the NMOS transistor 120. Thus, the drain current of the NMOS transistor 120 is supplied to the resistor 121, and the voltage VS2 rises.

It may be thought that the NMOS transistor 119 is turned off because a gate-source voltage thereof reduces. However, due to the function of the negative feedback, the NMOS transistor 119 is not turned off. In particular, through the function of the negative feedback, the voltage regulator 100 operates such that the voltage VREF and the voltage VFB become equal to each other. Thus, when the voltage VS2 rises, the voltage VG1 is increased by a corresponding amount. As a result, a predetermined voltage difference is maintained between the gate and the source of the NMOS transistor 119. In other words, even if the load current increases to thereby increase the voltage VG2, the predetermined voltage VOUT may be obtained.

A third state in which the load current further increases as compared to the second state such that the overcurrent protection function is put into operation is described.

When the current that flows to the load (not shown) connected to the output terminal 126 further increases, the voltage VG1 rises in the same mechanism as in the second state, but an upper limit of a voltage value of the voltage VG1 is limited by the voltage VS1. The voltage VS1 is determined by a sum of the voltage VREF and an absolute value |VGSP1| of the gate-source voltage of the PMOS transistor 115, and is expressed by Expression (2).

$$VS1=VREF+|VGSP1| \tag{2}$$

When the voltage VG2 becomes equal to the voltage VS1, the gate-source voltage of the NMOS transistor 119 decreases. Thus, when the drain current of the NMOS transistor 119 decreases, the voltage VGATE increases, thereby limiting the drain current I1 of the PMOS transistor 113. When an absolute value of a gate-source voltage of the PMOS transistor 123 is represented by |VGSP2|, and the size ratio between the PMOS transistors 113 and 112 is represented by K, the voltage VG2 at this time is expressed by Expression (3).

$$VG2 = \frac{I1 \times R}{K} + |VGSP2| \tag{3}$$

As described above, when the drain current I1 of the PMOS transistor 113 is limited, the voltage VS1 and the voltage VG2 are equal to each other, and the absolute values VGSP1 and VGSP2 are substantially equal to each other. Thus, from Expression (2) and Expression (3), a limited current I1*m* of the current I1 is expressed by Expression (4).

$$I1m = \frac{K \times VREF}{R} \tag{4}$$

As described above, the limited current I1*m* of the current I1 is determined, and the overcurrent protection function is put into operation. It is understood from Expression (4) that the limited current I1*m* is in proportion to the voltage VREF.

Figure 2:
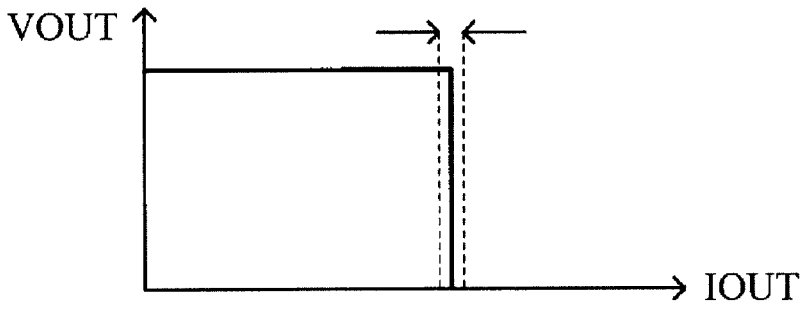
FIG. 2 is a graph for showing a waveform of an output voltage VOUT relative to an output current of the voltage regulator of FIG. 1.

FIG. 2 is a graph for showing a waveform of the output voltage VOUT relative to an output current IOUT of the voltage regulator 100 of this embodiment. The dotted lines indicate a fluctuation range of the limited current I1*m*. When the reference voltage source 114 is configured as a bandgap voltage source, fluctuation in the voltage VREF is about ±3%. Thus, fluctuation in the limited current I1*m* caused by the fluctuation in the voltage VREF may be suppressed to ±3%.

As described above, in the voltage regulator 100 of this embodiment, the fluctuation in the limited current I1*m* may be made much smaller than that in the related-art voltage regulator 300.

Figure 3:
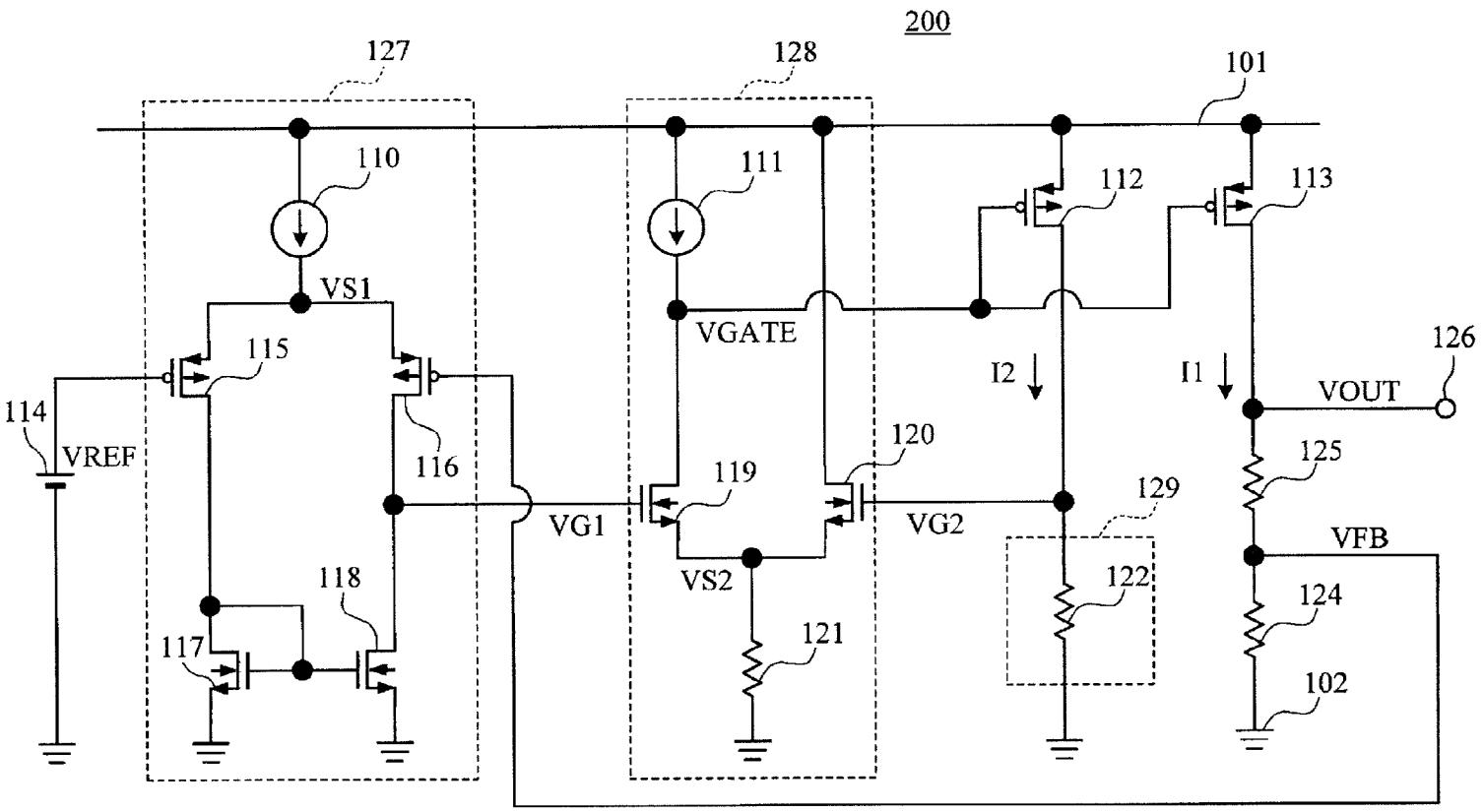
FIG. 3 is a circuit diagram for illustrating a voltage regulator of a second embodiment of the present invention.
Figure 4:
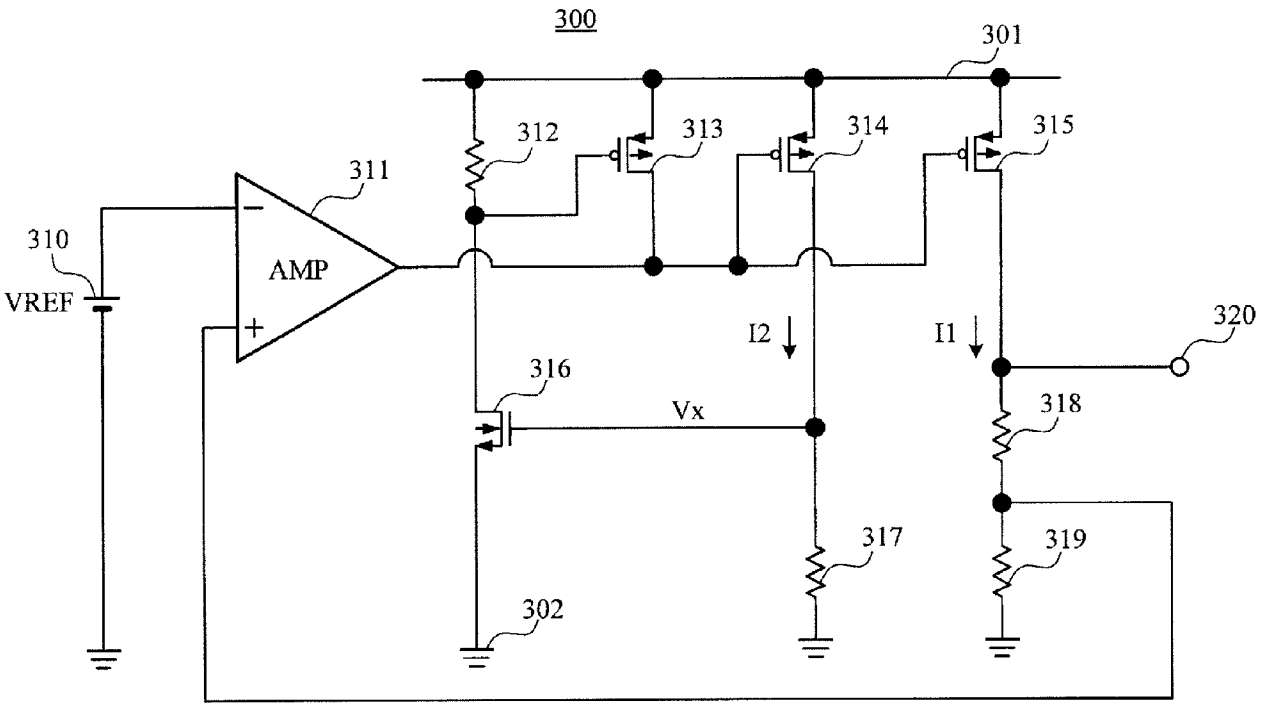
FIG. 4 PRIOR ART
FIG. 4 is a circuit diagram of the related-art voltage regulator.
Figure 5:
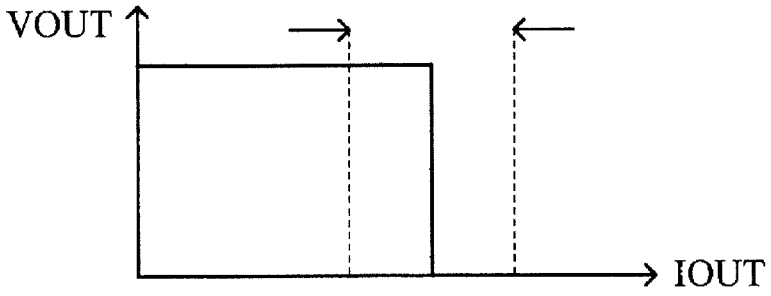
FIG. 5 PRIOR ART
FIG. 5 is a graph for showing a waveform of the output voltage VOUT relative to an output current of the voltage regulator of FIG. 4.

Next, with reference to FIG. 3, a voltage regulator 200 of a second embodiment of the present invention is described.

The voltage regulator 200 of this embodiment is different from the voltage regulator 100 of the first embodiment in that the voltage generating unit 129 has a different configuration. That is, as illustrated in FIG. 3, the voltage generating unit 129 is formed of the resistor 122 having one end connected to the drain of the PMOS transistor 112, and another end connected to the ground terminal 102.

Other configurations are the same as those of the voltage regulator 100 of FIG. 1. Thus, the same components are denoted with the same symbols and overlapping descriptions are omitted as appropriate.

Operation of the voltage regulator 200 of this embodiment is described. A difference in operation from the voltage regulator 100 of the first embodiment is described as in the description of the difference in configuration. In the operation of the voltage regulator 200 of this embodiment, the voltage VG2 in the third state is different from that in the voltage regulator 100 of the first embodiment, and is expressed by Expression (5) instead of Expression (3).

$$VG2 = \frac{I1 \times R}{K} \tag{5}$$

The voltage VS1 is the same as in Expression (2). Further, the voltage VS1 and the voltage VG2 are equal to each other in the third state, and hence the limited current I1*m* of the current I1 is expressed by Expression (6) from Expression (2) and Expression (5).

$$I1m = \frac{K}{R}(VREF + |VGSP1|) \tag{6}$$

The limited current I1*m* of the current I1 is determined in this way, and the overcurrent protection function is put into operation. It is understood from Expression (6) that the limited current I1*m* of this embodiment is in proportion to a sum of the voltage VREF and the absolute value |VGSP1| of the gate-source voltage of the PMOS transistor 115.

When the reference voltage source 114 is configured as the bandgap voltage source, the voltage of the voltage VREF and fluctuation thereof is 1.2 V±0.036 V. Here, when the absolute value |VGSP1| is 0.6 V±0.1 V, a voltage of a sum of the values is 1.8 V±0.136 V. As a result, the fluctuation in the limited current I1*m* caused by fluctuation in the sum of the voltage VREF and the absolute value |VGSP1| may be suppressed to ±7.6%.

As described above, even when the voltage generating unit 129 is formed of only the resistor 122, the fluctuation in the limited current I1*m* may be significantly suppressed as compared to the related-art voltage regulator 300. In general, the resistance value R has a negative temperature coefficient in many cases and the absolute value |VGSP1| also has a negative temperature coefficient. Thus, it is also possible to balance out those coefficients to improve temperature characteristics.

As described above, in the voltage regulator 200 of this embodiment, the fluctuation in the limited current I1*m* may be reduced and the temperature characteristics may be improved as compared to the related-art voltage regulator 300.

The embodiments of the present invention have been described above, but the present invention is not limited to the above-mentioned embodiments. It is to be understood that various modifications can be made to the present invention without departing from the gist thereof.

For example, in the example described in the first embodiment, the voltage generating unit 129 is formed of the PMOS transistor 123 and the resistor 122 connected in series. Further, the PMOS transistor 123 is arranged on the PMOS transistor 112 side, and the resistor 122 is arranged on the ground terminal 102 side. However, the resistor 122 may be arranged on the PMOS transistor 112 side, and the PMOS transistor 123 may be arranged on the ground terminal 102 side.

Further, in the embodiments, the examples in which MOS transistors are used in the voltage regulator are described. However, bipolar transistors or the like may be used.

Further, in the embodiments, a circuit configuration in which the polarities of the PMOS transistors and the NMOS transistors are reversed may be used.

What is claimed is:

1. A voltage regulator, comprising:

a first differential amplifier circuit configured to compare a voltage based on an output voltage and a reference voltage to each other, to thereby output a first voltage;

a second differential amplifier circuit configured to compare the first voltage and a second voltage to each other, to thereby output a third voltage;

a first transistor configured to receive the third voltage at a gate of the first transistor such that the output voltage is generated at a drain of the first transistor;

a second transistor, which includes a gate connected in common to the gate of the first transistor and has a predetermined size ratio to the first transistor; and a voltage generating unit, which includes one end connected to a drain of the second transistor and is configured to generate the second voltage at the one end.

2. A voltage regulator according to claim 1, wherein the voltage generating unit comprises a resistance element.

3. A voltage regulator according to claim 2, wherein the voltage generating unit further comprises a third transistor, which is connected to the resistance element in series, includes a gate and a drain that are connected to each other in common, and has the same conductivity type as conductivity types of transistors forming a differential pair of the first differential amplifier circuit.

* * * * *